US010054350B2

(12) United States Patent
Grewal et al.

(10) Patent No.: US 10,054,350 B2
(45) Date of Patent: Aug. 21, 2018

(54) TOP COOLING MODULE WITH ICE STORAGE AND DELIVERY

(75) Inventors: Rameet Singh Grewal, Pune (IN); Steven J. Kuehl, Stevensville, MI (US); Andrew D. Litch, St. Joseph, MI (US); Douglas D. Leclear, Benton Harbor, MI (US); Lorraine J. Westlake, Eau Claire, MI (US); Guolian Wu, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1012 days.

(21) Appl. No.: 13/474,856

(22) Filed: May 18, 2012

(65) Prior Publication Data

US 2013/0305769 A1 Nov. 21, 2013

(51) Int. Cl.

| | |
|---|---|
| ***F25C 1/00*** | (2006.01) |
| ***F25D 19/00*** | (2006.01) |
| ***F25C 5/20*** | (2018.01) |
| *F25C 5/185* | (2018.01) |
| *F25D 23/04* | (2006.01) |

(52) U.S. Cl.

CPC ..... *F25C 1/00* (2013.01); *F25C 5/22* (2018.01); *F25D 19/00* (2013.01); *F25C 5/185* (2013.01); *F25C 2400/04* (2013.01); *F25D 23/04* (2013.01); *F25D 2317/062* (2013.01); *F25D 2317/067* (2013.01); *F25D 2317/0666* (2013.01)

(58) Field of Classification Search

CPC ..... F25C 1/00; F25C 5/005; F25C 2400/04; F25C 5/185; F25D 19/00; F25D 2317/067; F25D 2317/062; F25D 2317/0666; F25D 23/04

See application file for complete search history.

(56) References Cited

U.S. PATENT DOCUMENTS

| | | | | |
|---|---|---|---|---|
| 1,788,392 A | | 1/1931 | Hull | |
| 1,841,616 A | | 1/1932 | Lipman | |
| 2,961,478 A | * | 11/1960 | Burns | H05K 9/0001 174/363 |
| 3,116,614 A | | 1/1964 | King | |
| 3,122,899 A | * | 3/1964 | Costantini | F25D 17/065 62/417 |
| 3,156,102 A | * | 11/1964 | Constantini | F25D 15/00 62/237 |
| 3,284,957 A | * | 11/1966 | Landis | B61D 19/00 49/493.1 |
| 3,333,347 A | * | 8/1967 | Mueller | D06F 58/06 34/139 |
| 3,433,031 A | | 3/1969 | Scheitlin | |

(Continued)

FOREIGN PATENT DOCUMENTS

| | | | |
|---|---|---|---|
| JP | 11264647 A | * | 9/1999 |
| KR | 20100113193 | | 10/2010 |

*Primary Examiner* — Kun Kai Ma
(74) *Attorney, Agent, or Firm* — Price Heneveld LLP

(57) ABSTRACT

A removable cooling module for a refrigerator includes a cooling unit positioned in a housing and removably coupled with a top wall of the refrigerator. An ice maker is coupled to the cooling unit. An ice bin is disposed in the housing and is adapted to receive and store ice from the ice maker. A duct is in communication with the cooling unit and is adapted to convey ice from the removable cooling module to an ice dispenser.

19 Claims, 13 Drawing Sheets

(56) References Cited

U.S. PATENT DOCUMENTS 3,616,624 A * 11/1971 Marsh ..... F24F 3/16 454/60
3,712,078 A * 1/1973 Maynard et al. ..... 62/448
3,882,637 A * 5/1975 Lindenschmidt ..... F25D 23/02 29/451
4,467,618 A * 8/1984 Gidseg ..... F25D 17/065 62/187
4,509,335 A 4/1985 Griffin et al.
4,776,182 A 10/1988 Gidseg
4,995,243 A 2/1991 Ward
5,029,737 A * 7/1991 Yamamoto ..... 222/526
5,081,850 A 1/1992 Wakatsuki et al.
5,086,627 A 2/1992 Borgen
5,199,273 A * 4/1993 Silva et al. ..... 62/298
5,622,059 A 4/1997 McClellan
5,632,160 A 5/1997 Harangozo et al.
5,875,645 A * 3/1999 Dunnigan ..... F25D 19/02 62/302
5,953,929 A * 9/1999 Bauman et al. ..... 62/259.1
6,070,424 A 6/2000 Bauman et al.
6,094,934 A * 8/2000 Rand ..... A47F 3/0408 312/116
6,209,342 B1 4/2001 Banicevic et al.
6,438,976 B2 8/2002 Shapiro et al.
6,578,376 B2 6/2003 Thurman
6,701,739 B2 * 3/2004 Morse ..... 62/277
6,735,959 B1 5/2004 Najewicz
6,948,324 B2 9/2005 Jin
6,964,177 B2 11/2005 Lee et al.
7,024,881 B2 4/2006 Jung
7,036,334 B2 5/2006 Ko et al.
7,219,509 B2 5/2007 Pastryk et al.
7,231,782 B2 6/2007 Jung
7,234,320 B2 6/2007 Fee et al.
7,237,399 B2 7/2007 Iguchi et al.
7,251,954 B2 8/2007 Fee et al.
7,266,972 B2 * 9/2007 Anselmino et al. ..... 62/344
7,430,876 B2 10/2008 Iguchi et al.
7,448,225 B2 11/2008 Iguchi et al.
7,596,956 B2 10/2009 Lilke
7,673,470 B2 3/2010 Kim et al.
7,703,298 B2 4/2010 Lee et al.
7,707,847 B2 5/2010 Davis et al.
7,762,098 B2 7/2010 Kim et al.
7,874,168 B2 1/2011 Cohen et al.
2006/0171822 A1 * 8/2006 Seagar et al. ..... 417/410.1
2009/0095009 A1 4/2009 Lee
2010/0126194 A1 5/2010 Flores et al.
2010/0139304 A1 6/2010 Kim et al.
2010/0139309 A1 6/2010 Kim et al.
2010/0180618 A1 7/2010 Gavan
2010/0180620 A1 7/2010 Lee et al.
2010/0192609 A1 8/2010 Chae et al.
2010/0192617 A1 8/2010 Chae et al.
2010/0257889 A1 10/2010 Lee
2011/0100046 A1 5/2011 Choi et al.
2011/0146331 A1 6/2011 Moon et al.
2011/0173925 A1 * 7/2011 Brown ..... E04B 1/14 52/794.1
2011/0277442 A1 * 11/2011 Drobniak ..... B01D 46/001 60/39.092

* cited by examiner

TOP COOLING MODULE WITH ICE STORAGE AND DELIVERY

BACKGROUND OF THE INVENTION

The present invention generally relates to a removable cooling module for a refrigerator, and more specifically to a removable cooling module with a cooling unit and an ice maker.

SUMMARY OF THE INVENTION

In one aspect of the present invention, a removable cooling module for a refrigerator includes a cooling unit positioned in a housing and removably coupled with a top wall of the refrigerator. An ice maker is coupled to the cooling unit. An ice bin is disposed in the housing and is adapted to receive and store ice from the ice maker. A duct is in communication with the cooling unit and is adapted to convey ice from the removable cooling module to an ice dispenser.

In another aspect of the present invention, a removable cooling module for a refrigerator includes a platform and a housing coupled to the platform. The platform and housing generally define a cavity. A cooling unit and an ice maker are disposed in the cavity. An ice conveyance aperture extends through the platform of the removable cooling module and conveys ice formed by the ice maker inside the cavity to a position outside the cavity. An airflow interface conveys cool air from inside the removable cooling module to an interior portion of the refrigerator.

In yet another aspect of the invention, a removable cooling module for a refrigerator includes a platform removably coupled with a top wall of the refrigerator. The platform defines an airflow interface and an ice conveyance aperture. A cooling unit is positioned on the platform. The cooling unit is in communication with a first cool air aperture that conveys cool air to a freezing compartment of the refrigerator and a separate second cool air aperture that conveys cool air to a refrigerating compartment. An ice maker is positioned on the platform. The ice maker is in communication with the ice conveyance aperture, such that ice from the ice maker is conveyed to an interior of the refrigerator.

These and other features, advantages, and objects of the present invention will be further understood and appreciated by those skilled in the art by reference to the following specification, claims, and appended drawings.

DETAILED DESCRIPTION OF EMBODIMENTS

Figure 1A:
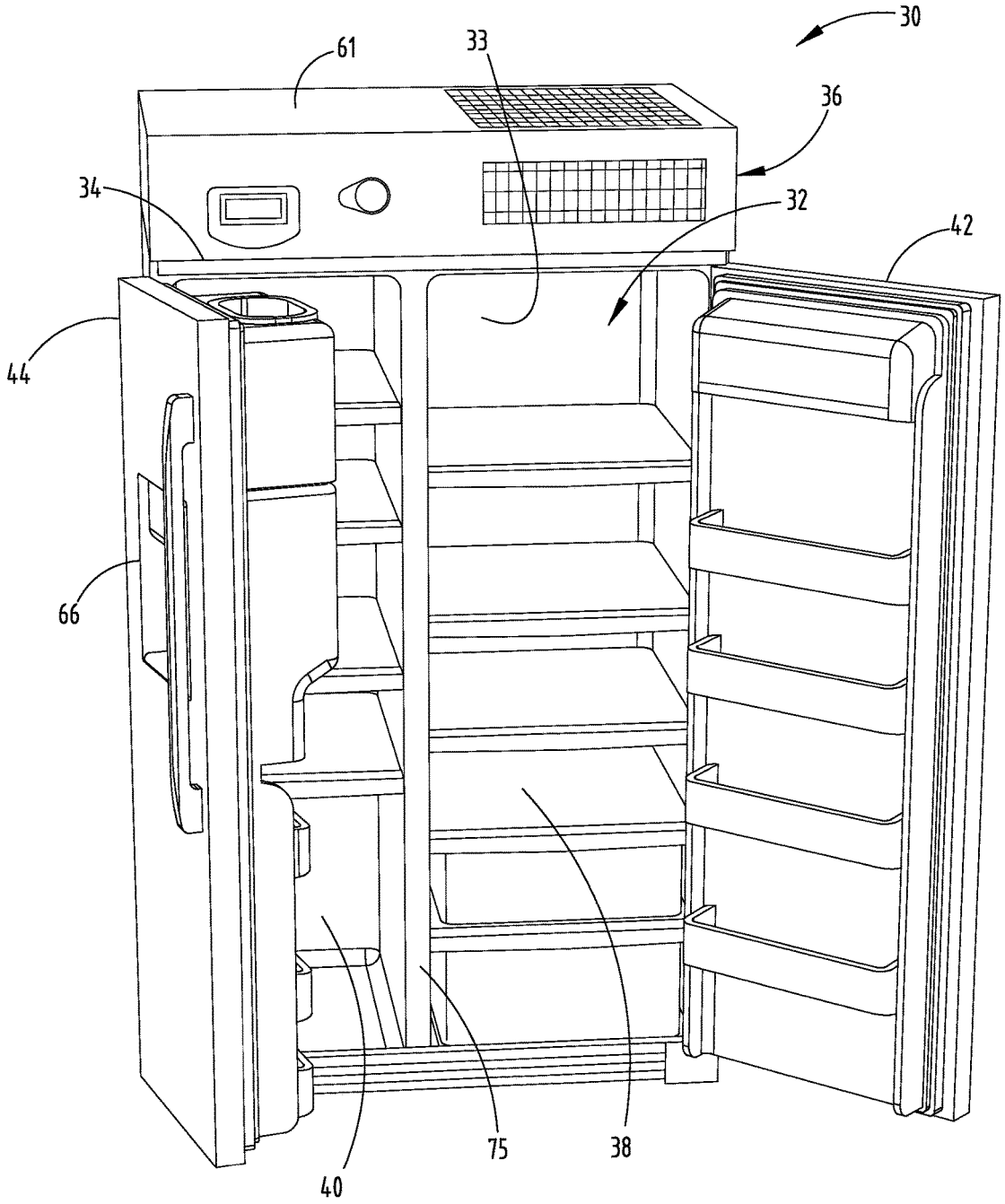
FIG. 1A is a perspective view of a side-by-side refrigerator incorporating a cooling module.
Figure 1B:
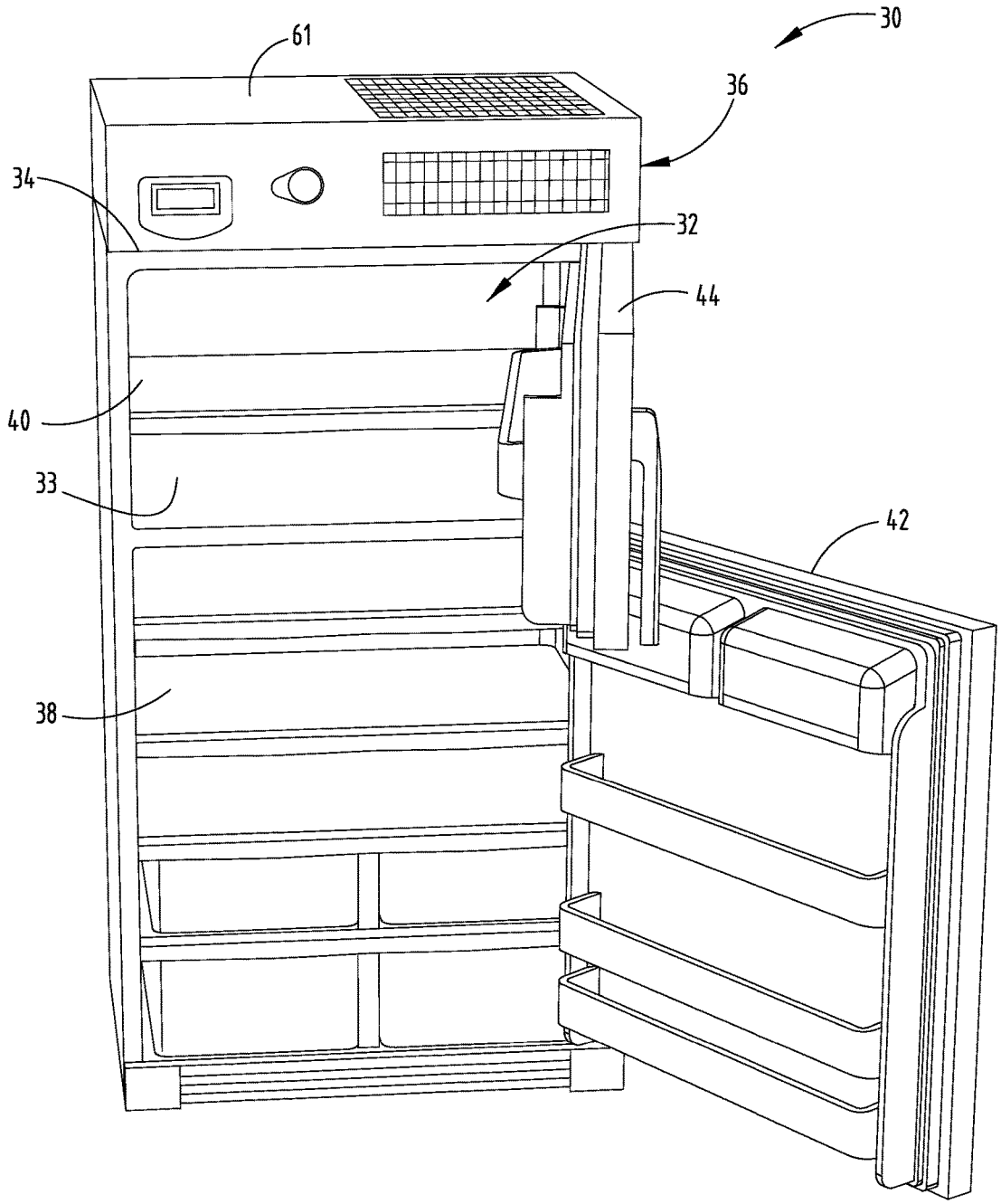
FIG. 1B is a perspective view of a freezer-on-top refrigerator incorporating a cooling module.
Figure 1C:
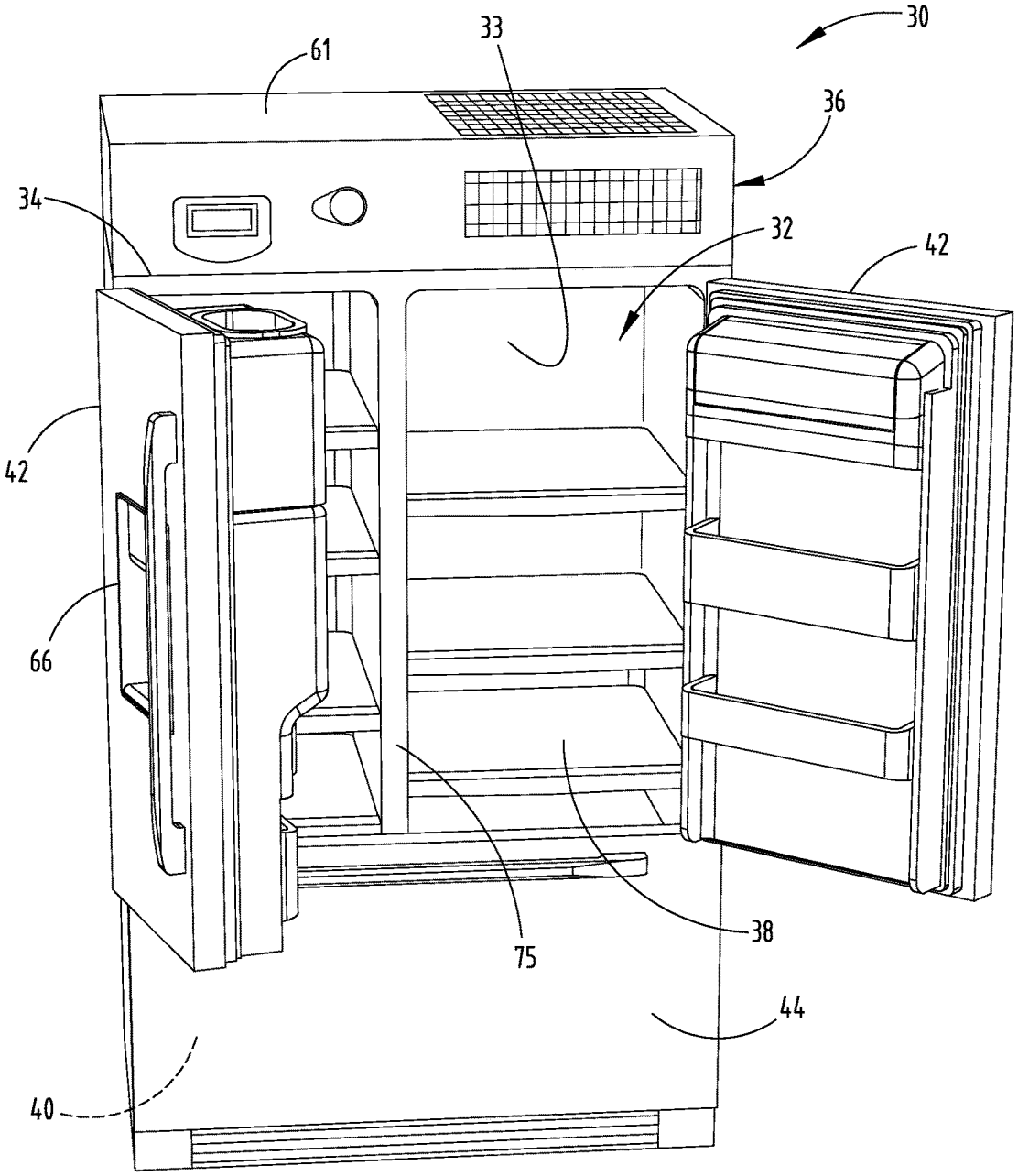
FIG. 1C is a perspective view of a freezer-on-bottom refrigerator incorporating a cooling module.

For purposes of description herein the terms "upper," "lower," "right," "left," "rear," "front," "vertical," "horizontal" and derivatives thereof shall relate to the invention as oriented in FIGS. 1A-1C. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Reference numeral 30 as shown in FIGS. 1A-1C generally refers to a refrigerator having a cabinet 32 with a top wall 34, and a removable cooling module 36 disposed on the top wall 34. The refrigerator cabinet 32 generally includes an inner liner 33 and an outer wrapper 35. The refrigerator cabinet 32 also includes a refrigerating compartment 38 and a freezing compartment 40. The refrigerating compartment 38 includes a refrigerating compartment door 42 and the freezing compartment 40 includes a freezing compartment door 44. As shown in FIGS. 1A-1C, the refrigerating compartment 38 and the freezing compartment 40 may be oriented in a variety of constructions, including a side-by-side configuration, with the freezing compartment 40 on the top, or with the freezing compartment 40 on the bottom. Regardless of the construction, the refrigerating compartment 38 is configured to store fresh foods at a cool above-freezing temperature. The freezing compartment 40 is configured to store frozen goods at a temperature below freezing.

Figure 2:
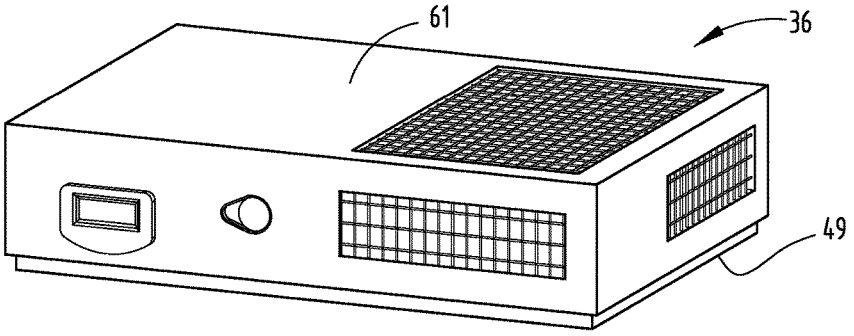
FIG. 2 is a top perspective view of a cooling module.
Figure 3:
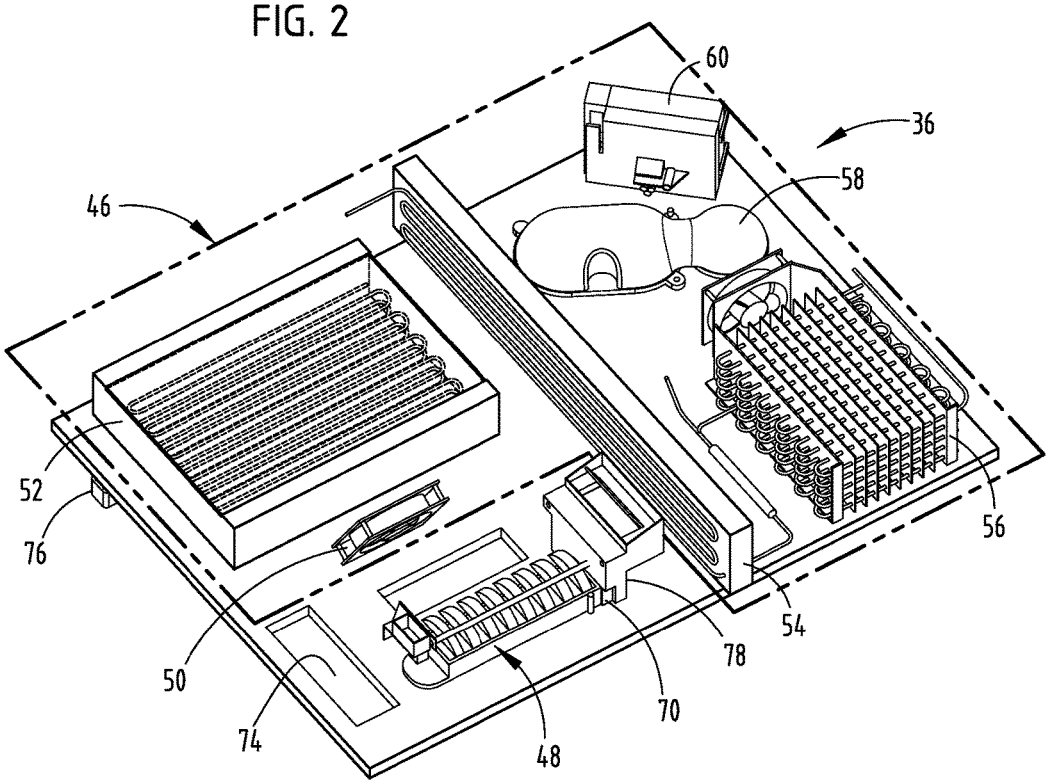
FIG. 3 is a top perspective view of a cooling module with the sides and top of the housing removed.
Figure 4:
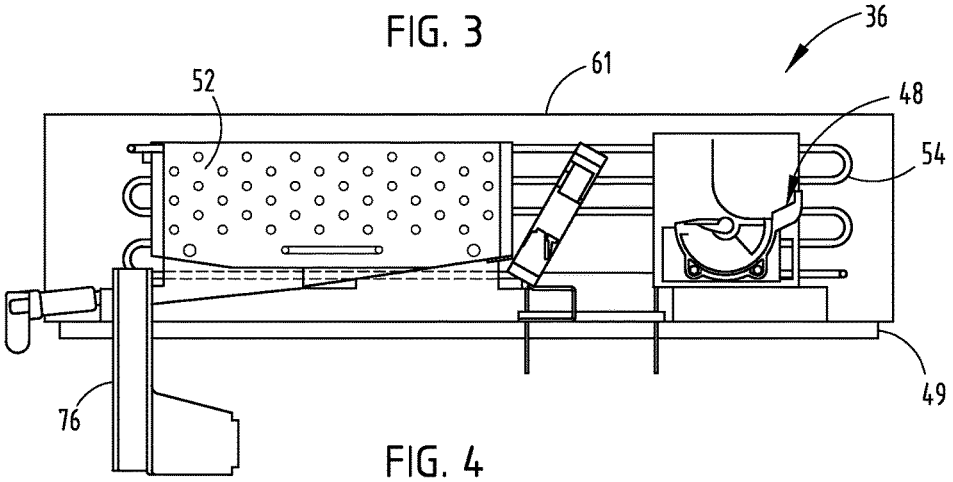
FIG. 4 is a side view of a cooling module with the side of the housing removed.

Referring to FIGS. 2-4, the cooling module 36 is removably disposable on the top wall 34 of the refrigerator cabinet 32, and can be connected along its bottom, or by its side to the top wall 34 of the refrigerator cabinet 32. The cooling module 36 includes a cooling unit 46 and an ice maker 48. In one embodiment, the cooling unit 46 includes a platform 49 that supports a fan 50, a horizontal evaporator 52, a suction line heat exchanger 54, a condenser 56, a low-profile linear compressor 58, and an inverter 60. The components of the cooling unit 46 may be arranged and interconnected in a standard configuration for such components. The cooling unit 46 and the ice maker 48 are not required in all embodiments to be located within a housing. The cooling module 36 is a stand alone unit that is configured for connection with a variety of refrigerator constructions and models. Further, the cooling module 36 can be removed easily for repair or replacement of the cooling module 36. The cooling module 36 includes a housing 61 that covers the components of the cooling module 36 and minimizes sounds emitted by the cooling module 36. The housing 61 and platform 49 define a cavity 63 within which the various components of the cooling module 36 are disposed.

The cooling module 36 is insulated to maintain temperature control. Insulation of the cooling module 36 may be the same as that used to control the temperature of the refrigerating and freezing compartments 38, 40, or may include any other suitable insulation as known in the art. Although several of the embodiments discussed herein illustrate the cooling module 36 mounted on the top wall 34 of the refrigerator 30, the cooling module 36 can also be arranged along a side of the cabinet 32, or otherwise around the periphery of the cabinet 32.

As generally illustrated in the embodiments of FIGS. 5B, 6B, 9B, and 10B, the cooling module 36 includes an ice bin 62 to store ice 64 generated by the ice maker 48. In these embodiments, a chute 66 is provided to convey ice 64 from the ice bin 62 to an ice dispenser 68 coupled to the refrigerator 30. In other embodiments, the ice bin 62 is located within the cabinet 32 or the doors 42, 44, and the chute 66 (or a combined duct 96 as described below) is provided to convey the ice 64 to the ice bin 62.

As illustrated in the embodiment of FIGS. 2-4, the cooling module 36 includes a first cool air aperture that functions as a refrigerating compartment airflow interface 70 to permit passage of cooled air to the refrigerating compartment 38 (FIGS. 1A-1C). The cooling module 36 also includes a second cool air aperture that functions as a freezing compartment airflow interface 74 to permit passage of cooled air to the freezing compartment 40 (FIGS. 1A-1C). The cooling module 36 also includes a return air interface 76 and an ice conveyance aperture 78 that functions as an ice dispensing interface with the refrigerator 30. The ice dispensing interface 78 may in some embodiments be coextensive with the refrigerating compartment airflow interface 70, the freezing compartment airflow interface 74, or both. The cooling module 36, as shown in FIGS. 2-4, operates to cool the refrigerating compartment 38 and the freezing compartment 40, and to provide ice 64 to a user of the refrigerator 30.

Various methods of routing ice 64 for delivery to a user are shown in FIGS. 5A-10B, as further described herein. The chutes 66 shown with these embodiments may be used with various refrigerator configuration combinations (i.e., side-by-side, freezer-on-top, and freezer-on-bottom), and are not limited to the particular configuration shown. FIGS. 5A-10B also illustrate various configurations for the attachment and interaction between the cooling module 36 and the refrigerator cabinet 32, showing various embodiments of the cooling module 36 and the interface of such embodiments with refrigerating and freezing compartment doors 42, 44. As with the chutes 66, these various embodiments of the cooling module 36 can be used with various configurations of the refrigerator 30.

Figure 5A:
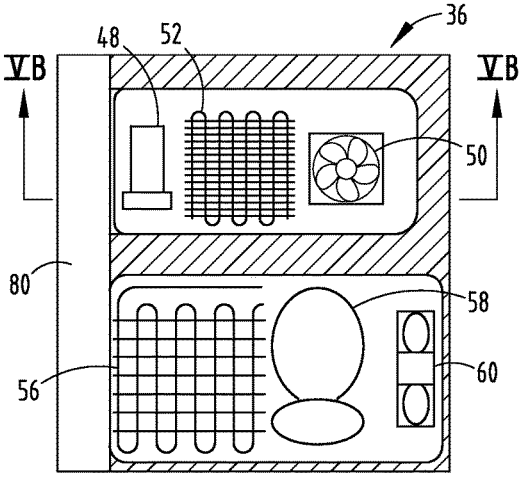
FIG. 5A is a top view of one embodiment of a cooling module with the top of the housing removed.
Figure 5B:
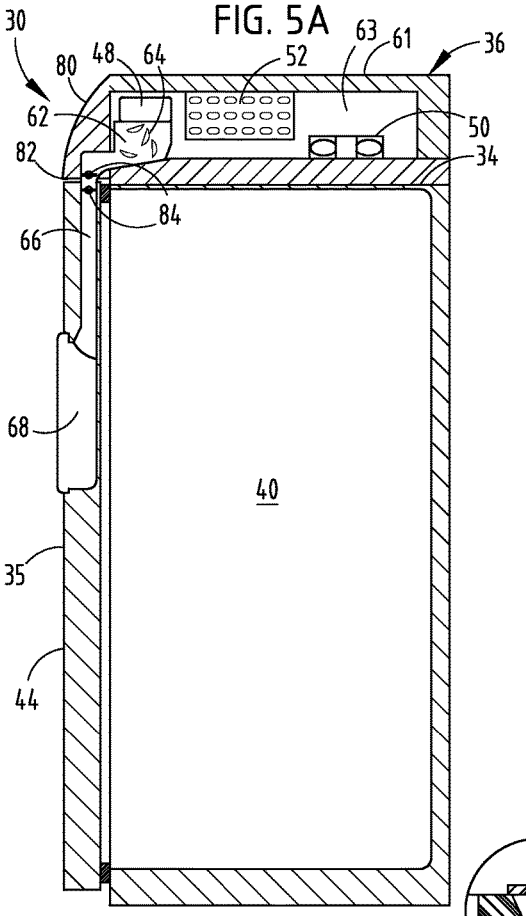
FIG. 5B is a side cross-sectional view of the embodiment of the cooling module along the line VB shown in FIG. 5A, installed on a refrigerator.

The embodiment depicted in FIGS. 5A and 5B generally illustrates one embodiment of the refrigerator 30 that includes the refrigerating compartment 38 and the freezing compartment 40 in a side-by-side configuration with a central wall 75 disposed between the refrigerating compartment 38 and the freezing compartment 40. The cooling module 36 is disposed on the top wall 34. The cooling module 36 includes the ice maker 48 and the ice bin 62, to hold ice 64 produced by the ice maker 48. The chute 66 extends generally horizontally outward from the ice bin 62, then generally downwardly into the door 44. The ice dispenser 68 is located in the door 44 of the freezing compartment 40.

As shown in the illustrated embodiment of FIG. 5A, a transition member 80 may be provided to enclose the chute 66 after the chute 66 leaves the cooling module 36 and before the chute 66 enters the door 44, which may be insulated to maintain a cold temperature for the ice 64. In such an arrangement, the chute 66 extends at least partially outside of the door 44. One or more gaskets 82 are provided where the chute 66 enters the door 44, to ensure that there is a sealed connection when the freezing compartment door 44 is closed, but that the door 44 is permitted to freely open and close. Gates 84 may also be provided in the chute 66 to control the flow of ice 64. As shown in FIG. 5B, one or more gates 84 may be located proximate the cooling module 36. The configuration of the cooling module 36 shown in FIGS. 5A and 5B could also be used where the ice dispenser 68 is located in the refrigerating compartment door 42, with the chute 66 leading from the ice bin 62 through the refrigerating compartment door 42 to the ice dispenser 68. Actuation of the ice dispenser 68 causes the gates 84 to open, which consequently causes ice 64 to dispense downward into the chute 66. The ice dispenser 68 includes a cavity adapted to receive a receptacle, such as a cup of a user, which can catch the ice 64.

Figure 6A:
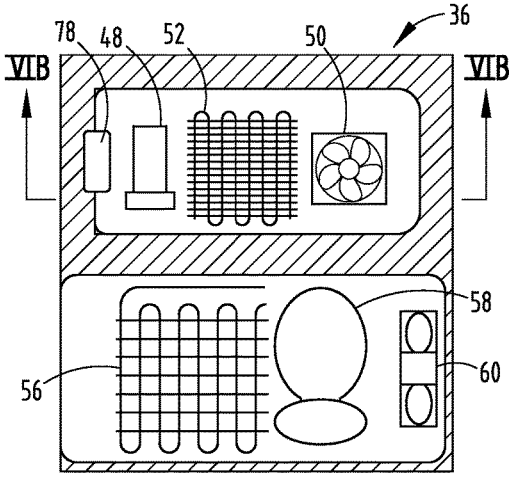
FIG. 6A is a top view of a second embodiment of a cooling module with the top of the housing removed.
Figure 6C:
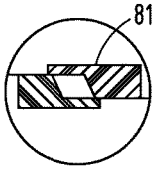
FIG. 6C is an enlarged view of the interface between the cooling module and ice chute as shown in VIC of FIG. 6B.
Figure 6B:
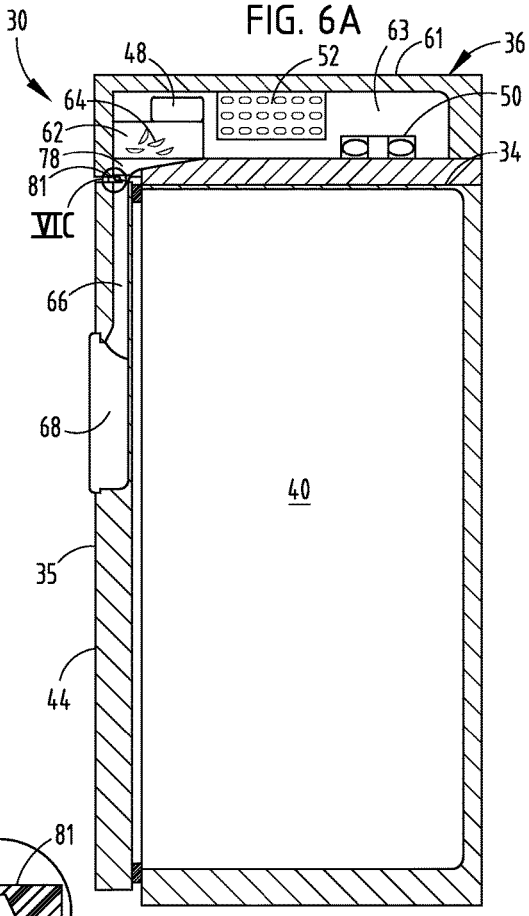
FIG. 6B is a side cross-sectional view of the embodiment of the cooling module along the line VIB shown in FIG. 6A, installed on a refrigerator.

FIGS. 6A and 6B illustrate an additional embodiment of the refrigerator 30, also having a side-by-side configuration. In this embodiment, the cooling module 36 extends forwardly over the freezing compartment door 44, with the ice dispensing interface 78 of the cooling module 36 positioned above the entrance to the chute 66 on the bottom side of the cooling module 36. The chute 66 is located primarily (or entirely) within the freezing compartment door 44. A gasket assembly 81 may be disposed between the chute 66 and the ice dispensing interface 78 in a "clam shell" configuration, from front to back to allow the freezing compartment door 44 to open and close, as shown in FIG. 6C, while limiting the loss of cooled air from the cooling module 36 through the chute 66. The chute 66 then extends from the top of the freezing compartment door 44 to the ice dispenser 68 located in the freezing compartment door 44. This configuration could also be used to route ice 64 to a refrigerator door-mounted ice dispenser 68. One potential advantage of using the embodiment shown in FIGS. 6A and 6B is an increased storage capacity for ice 64 in the cooling module 36. It is contemplated that any of a variety of ice metering devices, such as the gate 84 of FIGS. 5A and 5B, could also be used for the embodiment of FIGS. 6A and 6B.

Figure 7A:
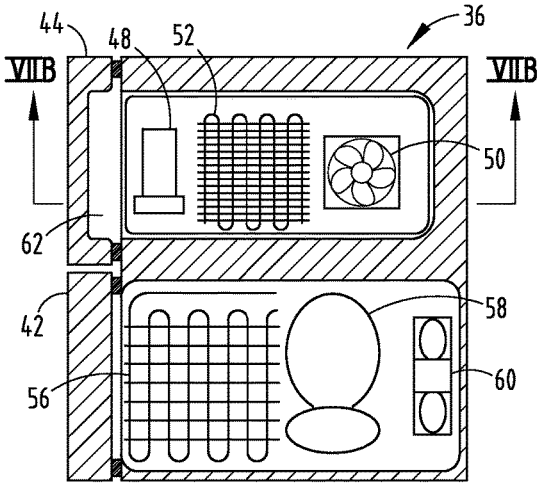
FIG. 7A is a top view of a third embodiment of a cooling module with the top of the housing removed.
Figure 7B:
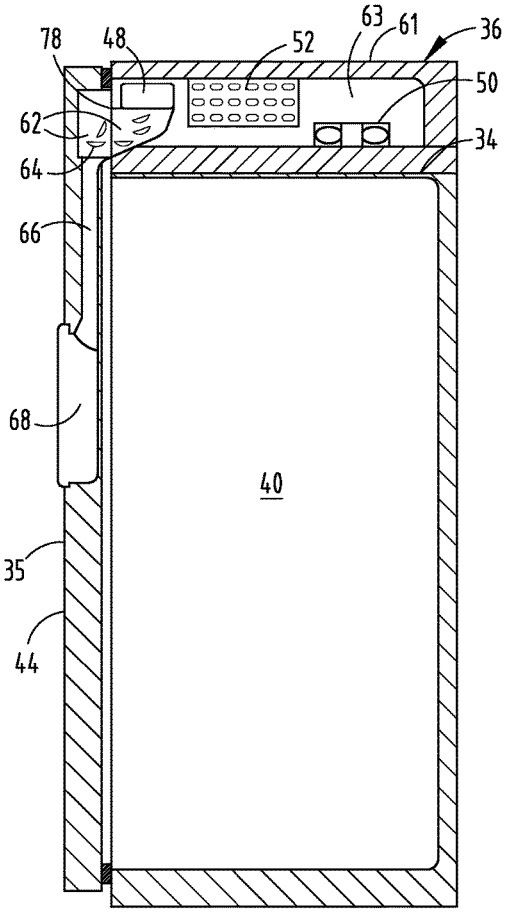
FIG. 7B is a side cross sectional view of the embodiment of the cooling module along the line VIIB as shown in FIG. 7A, installed on a refrigerator.

FIGS. 7A and 7B illustrate yet another embodiment of the refrigerator 30 used in conjunction with the removable cooling module 36. The illustrated embodiment includes a side-by-side configuration, where the doors 42, 44 extend above the top wall 34 of the refrigerator 30. The cooling module 36 is located above the top wall 34 of the refrigerator 30, and at least partially behind the doors 42, 44. The doors 42, 44 include a height that is substantially the same height as the refrigerator 30 and the cooling module 36 combined. In this embodiment, ice 64 is made by the ice maker 48 in the cooling module 36, and is stored in the ice bin 62 located in the freezing compartment door 42, the cooling module 36, or both the freezing compartment door 42 and the cooling module 36. Ice 64 is relayed directly from the ice maker 48 to the ice bin 62 in the door 44. The chute 66 extends from the ice bin 62 to the dispenser 68 where the ice 64 can be dispensed to a user.

Figure 8A:
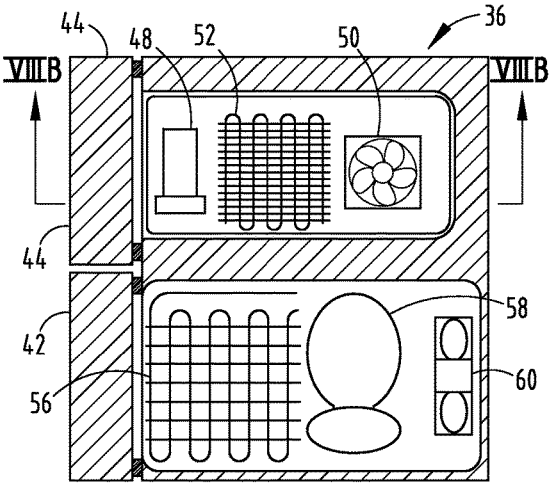
FIG. 8A is a top view of a third embodiment of a cooling module with the top of the housing removed.
Figure 8B:
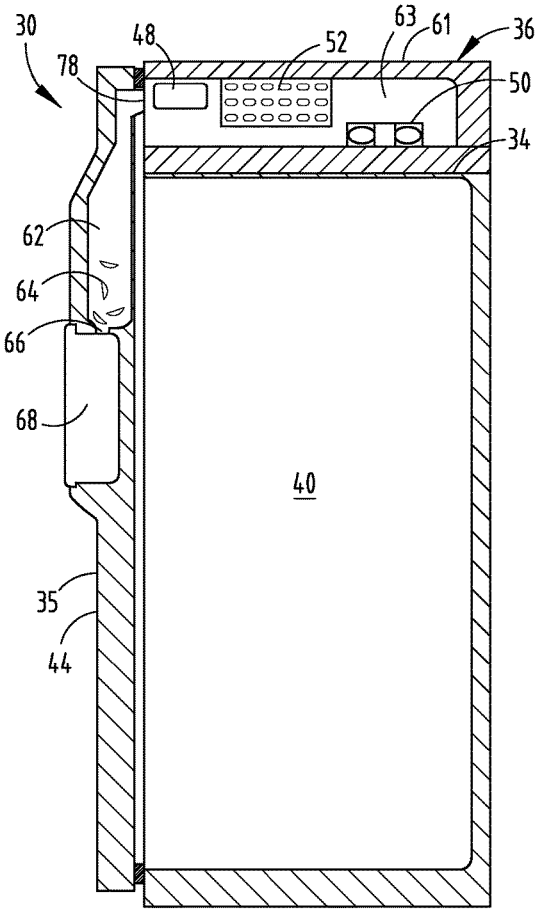
FIG. 8B is a side cross sectional view of the embodiment of the cooling module along the line VIIIB as shown in FIG. 8A, installed on a refrigerator.

As shown in the embodiment of FIGS. 8A and 8B, to increase the storage volume for ice 64, the freezing compartment door 44 may be shaped with an expanded profile, allowing additional volume for the ice bin 62 to hold ice 64 within the freezing compartment door 44. In this embodiment, the ice bin 62 is the sole ice storage area for the refrigerator 30. An ice metering device, such as the gates 84 or a trap door assembly, may be used to dispense ice 64 from the ice bin 62 to the ice dispenser 68. The expanded profile associated with the ice bin 62 may extend externally, as illustrated, or may extend internally into the freezing compartment 40. The doors 42, 44 extend above the bottom surface of the cooling module 36 and communication between the ice dispensing interface 78 and the chute 66 is on the front-facing side of the cooling module 36 adjacent the doors 42, 44. The ice storage bin 62 located in the doors 42, 44 may be located above (FIG. 7B) or below (FIG. 8B) the top wall 34 of the refrigerator 30.

Figure 9A:
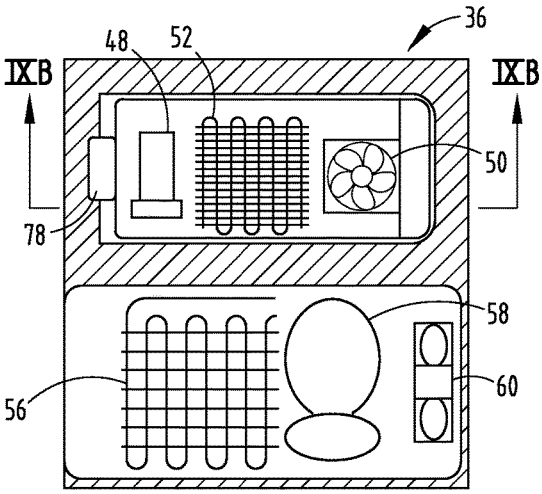
FIG. 9A is a top view of a third embodiment of a cooling module with the top of the housing removed.
Figure 9B:
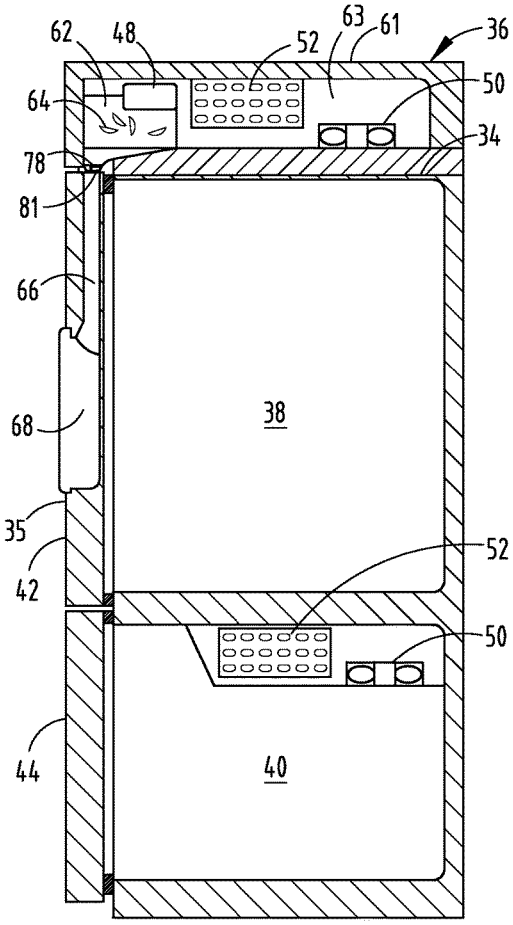
FIG. 9B is a side cross sectional view of the embodiment of the cooling module along the line IXB as shown in FIG. 9A, installed on a refrigerator.

FIGS. 9A and 9B illustrate another embodiment of the refrigerator 30, wherein the freezing compartment 40 is located below the refrigerating compartment 38, and wherein the cooling module 36 extends forward over the refrigerating compartment door 42. The ice dispensing interface 78 of the cooling module 36 is located above the entrance to the chute 66, and the chute 66 is located primarily (or entirely) within the refrigerating compartment door 42. The chute 66 interacts with the ice dispensing interface 78, which is disposed at an overhang of the cooling module 36. The overhang extends over a top portion of the refrigerating compartment door 42. The gasket assembly 81 allows the refrigerating compartment door 42 to open and close, while maintaining a tight seal when closed. The chute 66 extends from the ice dispensing interface 78 to the ice dispenser 68 located in the refrigerating compartment door 42. Clearly, as shown in the comparison of FIGS. 6 and 9, various aspects of several embodiments, as described herein, are interchangeable. For example, arrangements of the chute 66 that operate with a side-by-side configuration may also be used in a freezer-on-bottom configuration or a freezer-on-top configuration.

Figure 10A:
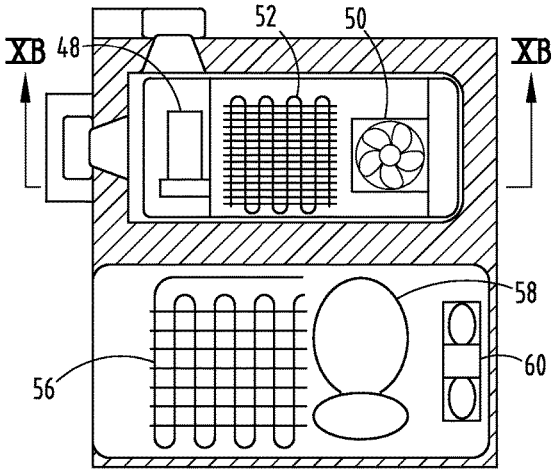
FIG. 10A is a top view of a third embodiment of a cooling module with the top of the housing removed.
Figure 10B:
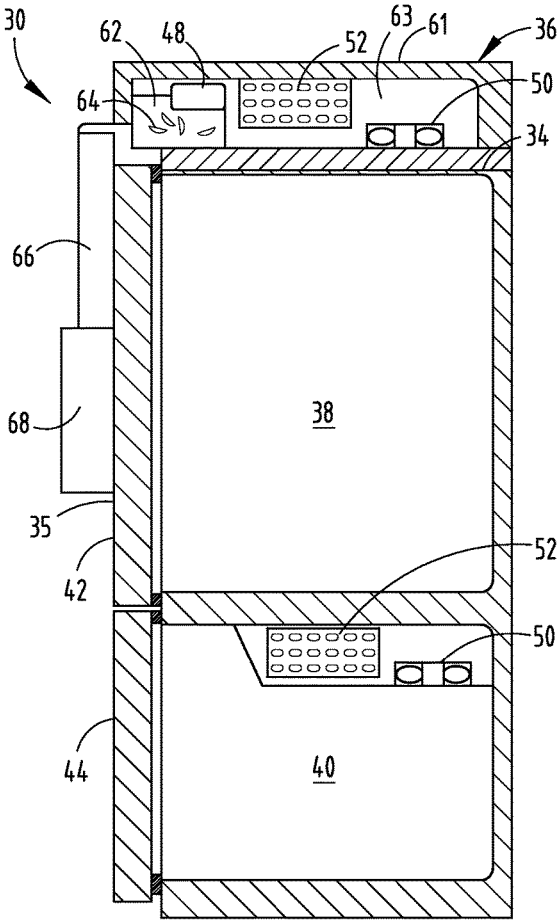
FIG. 10B is a side cross sectional view of the embodiment of the cooling module along the line XB as shown in FIG. 10A, installed on a refrigerator.

FIGS. 10A and 10B illustrate yet another embodiment of the present invention, wherein the chute 66 and the ice dispenser 68 are externally mounted outside the outer wrapper 35 of the refrigerating compartment door 42. According to this embodiment, the chute 66 and the ice dispenser 68 could also be located proximate a side of the cabinet 32. In this embodiment, the ice bin 62 is located within the cooling module 36, to maintain a steady temperature for the storage of ice 64. Additionally, a separate control panel may be utilized to control the externally mounted ice dispenser 68, the ice maker 48, or both.

Also, as illustrated in FIGS. 9 and 10, additional or auxiliary cooling units 46, or portions thereof, may optionally be provided in a separate freezing compartment 40. These additional cooling units 46 prove beneficial in freezer-on-bottom configurations, but could ultimately be used in any arrangement of the refrigerating and freezing compartments 38, 40.

In the embodiments described herein, the cooling module 36 also provides cooled air to the refrigerating compartment 38, the freezing compartment 40, or both, through the refrigerating compartment airflow interface 70 or the freezing compartment airflow interface 74. As described herein with respect to the various embodiments of the chutes 66, various embodiments of ducts 88, 94, 96 shown in FIGS. 11-19 may be used with various refrigerator configurations (e.g., side-by-side, freezer-on-top, and freezer-on-bottom), and are not limited to the particular configurations shown.

Figure 11:
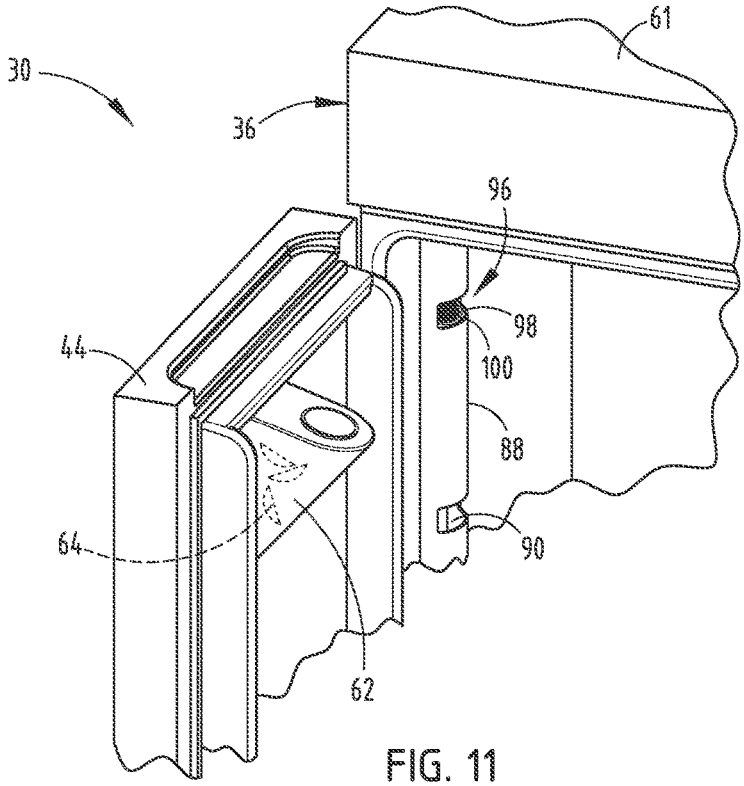
FIG. 11 is a perspective view of one embodiment of a refrigerator with an open door, with the ducting for distribution of cooling air and ice depicted.

As best shown in FIG. 11, to convey cooled air from the cooling module 36 to the desired location within the refrigerating compartment 38 or the freezing compartment 40, the cool air duct 88 communicates with the refrigerating compartment airflow interface 70 (FIG. 3) or the freezing compartment airflow interface 74 (FIG. 3), as needed, and terminates in the desired refrigerating compartment 38 or the freezing compartment 40. In some embodiments, the same cool air duct 88 can be used to supply cooled air to both the refrigerating compartment 38 and the freezing compartment 40. In such cases, more than one outlet 90 is provided in the cool air duct 88 for the cooled air.

As illustrated, the cool air duct 88 extends through the doors 42, 44, along the interior of the insulation of the refrigerating compartment 38 or the freezing compartment 40, or within or along a wall between the refrigerating compartment 38 and the freezing compartment 40 in a side-by-side refrigerator-freezer configuration. The cool air duct 88 can also be located within a layer of insulation for the refrigerating or freezing compartments 38, 40, or can be affixed interior in the relevant refrigerating or freezing compartment 38, 40 from the insulation. The cool air duct 88 generally extends from the outer surface of the cabinet 32 (or the doors 42, 44) where it interfaces with the refrigerating compartment airflow interface 70 or the freezing compartment airflow interface 74 of the cooling module 36. The cool air duct 88 relays cooled air to the interior of the cabinet 32 where the cooled air is released into the refrigerating compartment 38 or the freezing compartment 40, as needed.

Figure 17:
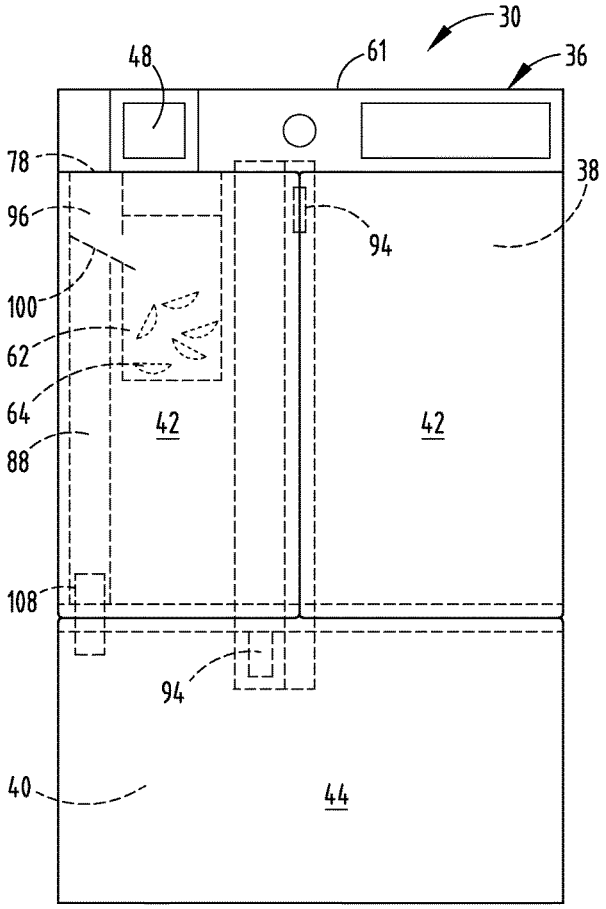
FIG. 17 is a front view of a cooling module installed on a refrigerator.

The cooling module 36 also receives return circulating air from the refrigerating compartment 38, the freezing compartment 40, or both, through the return air interface 76. Air returning to the cooling module 36 to be cooled is conveyed from the relevant refrigerating or freezing compartment 38, 40 by a return air duct 94, which communicates with the return air interface 76, as best shown in FIG. 17. A separate return air duct 94 may be provided for each compartment 38, 40, or a single return air duct 94 may be provided. In one embodiment where a single return air duct 94 is provided, the return air duct 94 may be separated to include a plurality of passageways 95, with at least one passageway 95 for air returning from the refrigerating compartment 38 and at least one passageway 95 for air returning from the freezing compartment 40. The return air duct 94 may be disposed in the wall between the refrigerating compartment 38 and the freezing compartment 40 in a side-by-side configuration of the refrigerator 30, to facilitate receiving return air from each refrigerating or freezing compartment 38, 40 without impinging on storage space in either the refrigerating compartment 38 or the freezing compartment 40.

Figure 12A:
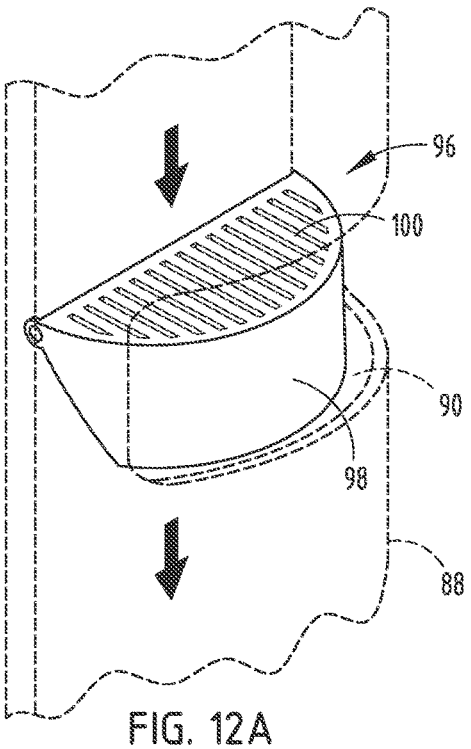
FIG. 12A is one embodiment of a deflector, shown in the closed position.
Figure 12B:
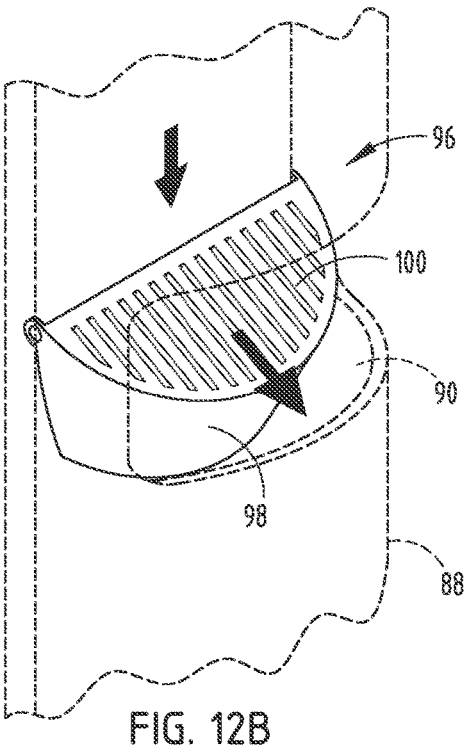
FIG. 12B is the embodiment of the deflector shown in FIG. 12A in the open position.

As illustrated in FIGS. 11-12B, the cooling module 36 delivers ice 64 and cooled air through a combined duct 96, as illustrated in FIG. 11. The combined duct 96 may deliver ice 64 to the ice storage bin 62 located within the refrigerating compartment 38 or the freezing compartment 40. However, the ice bin 62 may optionally supply the ice dispenser 68 located in the refrigerating compartment door 42 or the freezing compartment door 44. The combined duct 96, like the cool air duct 88, may be located within the layer of insulation for the refrigerating or freezing compartments 38, 40. The combined duct 96 may also be affixed interior in the relevant refrigerating or freezing compartment 38, 40 from the insulation, or may extend along or within a center wall separating the refrigerating and freezing compartments 38, 40 of a side-by-side configuration of the refrigerator 30. The combined duct 96 may also extend in whole or in part through the doors 42, 44.

As shown in FIG. 11, when the combined duct 96 is used, an outlet 98 for the ice 64 is provided, so that the ice 64 can be diverted from the combined duct 96 into the ice bin 62 via an ice deflector. In the embodiment shown in FIGS. 11 and 12, a rotatable slotted deflector 100 is provided in the combined duct 96. When the rotatable slotted deflector 100 is in a first position (as shown in FIG. 12A), the rotatable slotted deflector 100 blocks the flow of ice 64 from traveling past the rotatable slotted deflector 100 in the combined duct 96, and closes the outlet 98, but allows the passage of the cooled air through the rotatable slotted deflector 100. When the rotatable slotted deflector 100 is rotated to a second position (as shown in FIGS. 11 and 12B), the ice 64 is deflected through the outlet 98 and into the ice bin 62. However, the cooled air is permitted to flow through the rotatable slotted deflector 100.

Figure 13A:
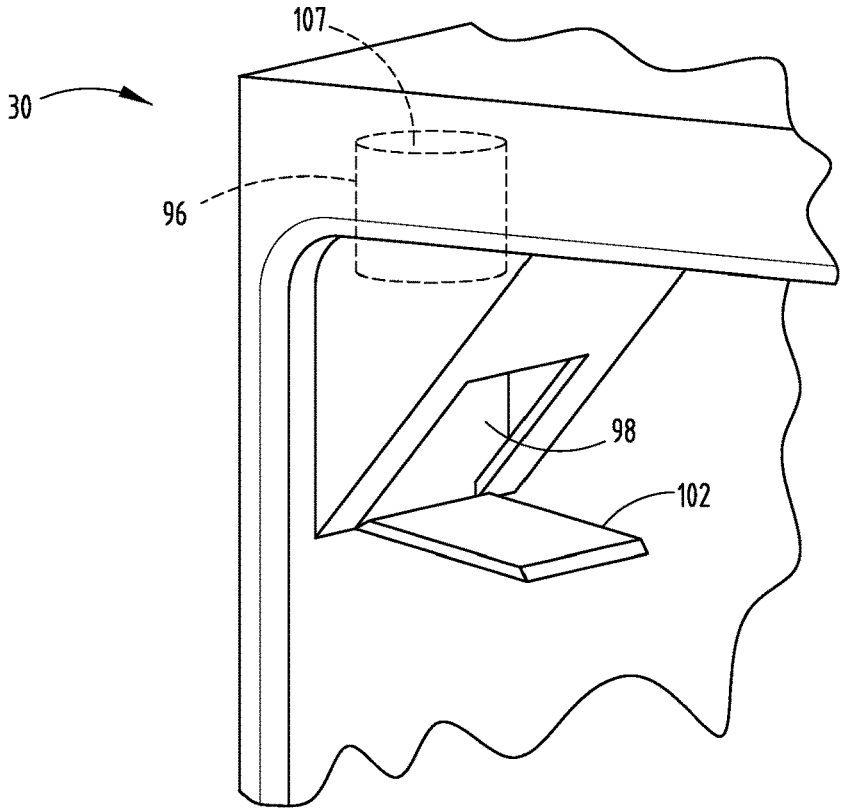
FIG. 13A is a perspective view of an embodiment of ducting for ice and air transfer having an ice deflector flap.
Figure 13B:
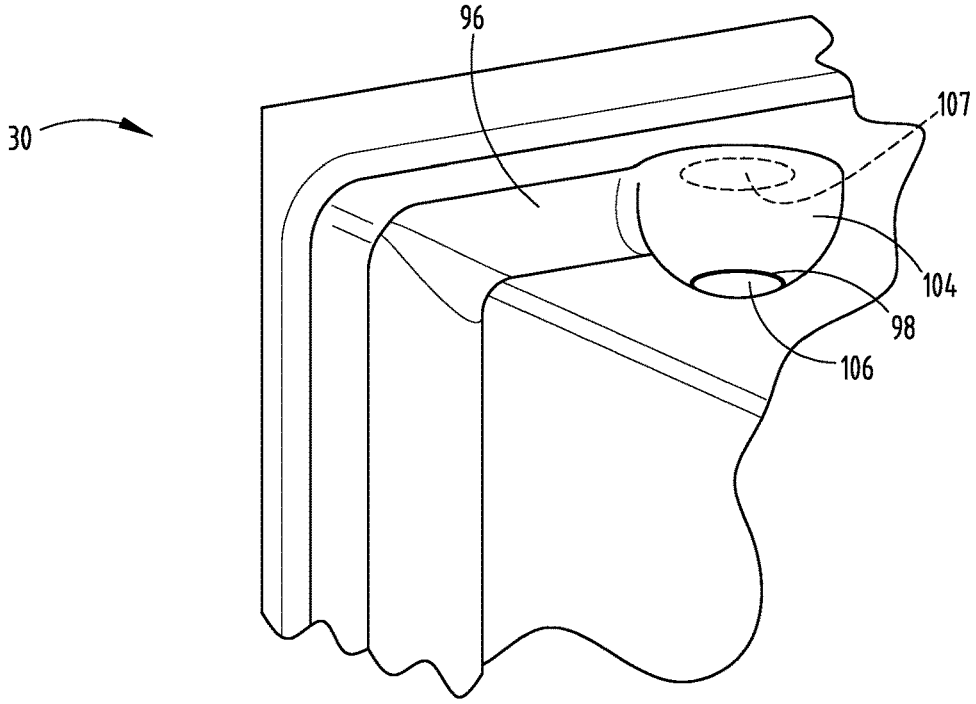
FIG. 13B is a perspective view of an embodiment of ducting for ice and air transfer having an ice collector.

FIGS. 13A and 13B illustrate various delivery ducting embodiments that extend through the top wall 34 of the refrigerator 30. Alternative arrangements to direct the flow of ice 64 from the combined duct 96 into the ice bin 62 disposed in the refrigerating or freezing compartment 38, 40 may include an ice deflector flap 102 to deflect the ice 64 into the ice bin 62, as shown in FIG. 13A, or an ice collector 104 with an ice flap 106 to allow the ice 64 to drop into the ice bin 62 through an aperture 107 in the top wall 34 of the refrigerator 30, as shown in FIG. 13B. It is contemplated that the ice collector 104 be located on the interior of the top wall 34, or located on a side or back portion of the cabinet 32. The ice flap 106 can be spring-loaded, and operable to open due to the weight of the ice 64 accumulated in the ice collector 104. Alternatively, the ice flap 106 can be activated to open as a trap door assembly when the ice maker 48 expels ice 64 or upon demand of ice 64 through the ice dispenser 68. A motorized system as known in the art may be used to drop ice 64.

Figure 14A:
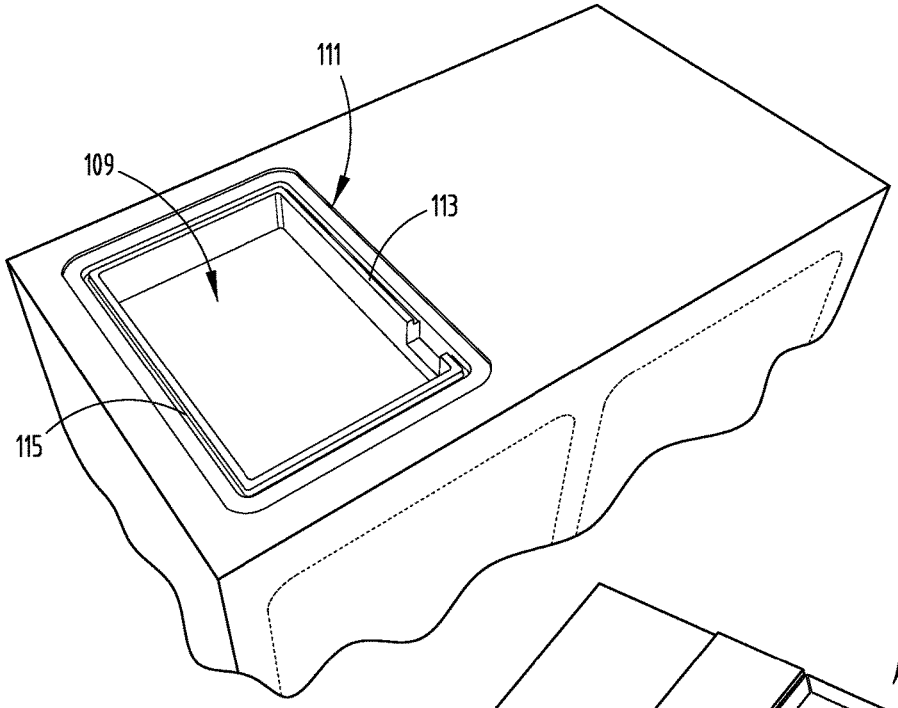
FIG. 14A is a top perspective view of an embodiment of a refrigerator with ducting for direct ice and air delivery to a freezing compartment of a refrigerator.
Figure 14B:
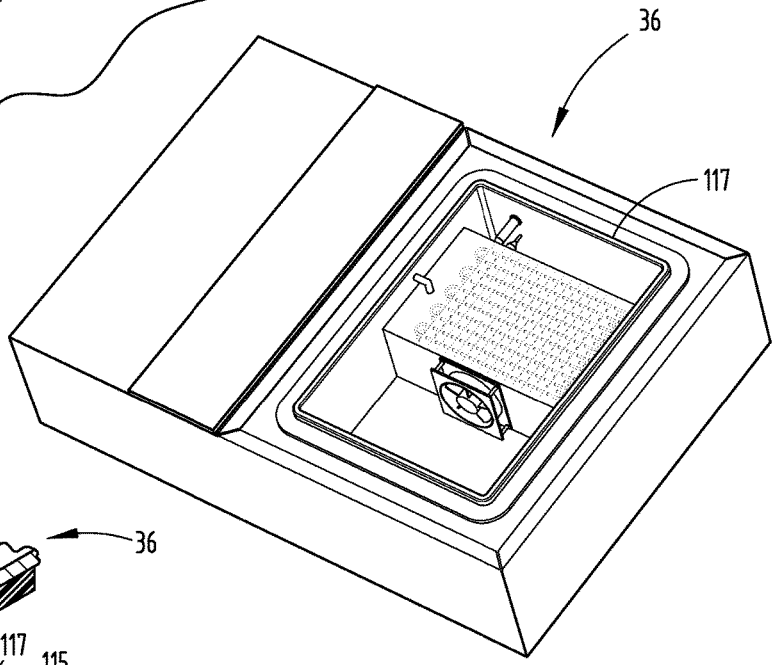
FIG. 14B is a bottom perspective view of a removable cooling module adapted to interface with the refrigerator of FIG. 14A.
Figure 14C:
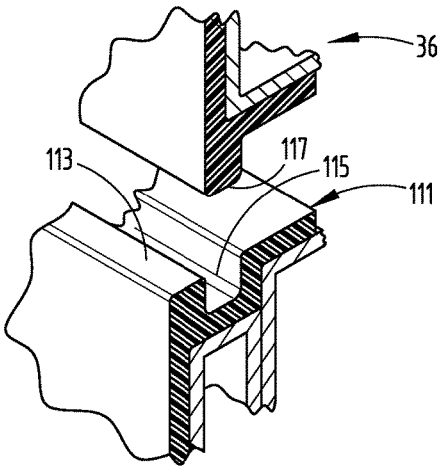
FIG. 14C is an enlarged partial cross-sectional view of a portion of a gasket assembly.

Referring now to FIGS. 14A-14C, another embodiment of the present invention includes the removable cooling module 36 having an enlarged ice and airflow interface 109 adapted to relay ice and cooled air from the removable cooling module 36 to the refrigerator 30, and more specifically, to the freezing compartment 40 or the refrigerating compartment 38. The ice and airflow interface 109 includes a gasket assembly 111 positioned between the removable cooling module 36 and the refrigerator 30. The gasket assembly 111 includes a gasket 113 with a perimeter channel 115 adapted to receive a peripheral protrusion 117 that extends from the removable cooling module 36. The perimeter channel 115 and the peripheral protrusion 117 include a complementary construction that allows for secure engagement of the removable cooling module 36 and the refrigerator 30. During installation, the peripheral protrusion 117 is inserted into the perimeter channel 115 to form a substantially airtight seal between the refrigerator 30 and the removable cooling module 36. It is contemplated that the peripheral protrusion 117 could also extend from the refrigerator 30 and the gasket assembly 111 could extend from the removable cooling module 36. Both cooled air and ice are relayed from the removable cooling module 36 to the refrigerator 30. The removable cooling module 36 may simply rest on top of the refrigerator 30 and be held in place by the protrusion 117, or may be fastened to a top portion of the refrigerator 30. In the former instance, it is contemplated that the weight of the removable cooling module 36 will maintain the removable cooling module 36 in position on the refrigerator 30, preventing any danger of the removable cooling module 36 becoming accidentally dislodged.

Figure 15A:
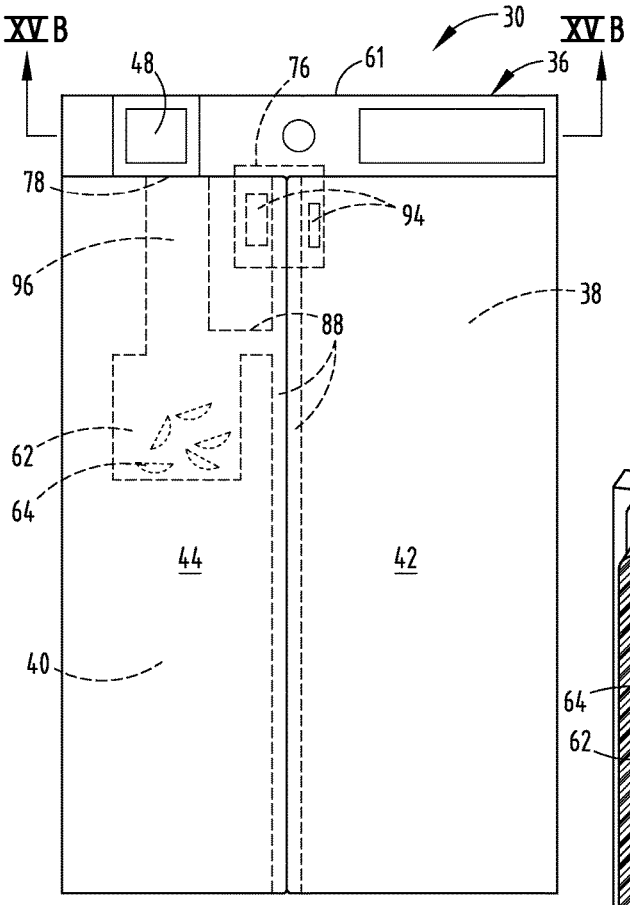
FIG. 15A is a front view of a cooling module installed on a refrigerator.
Figure 16:
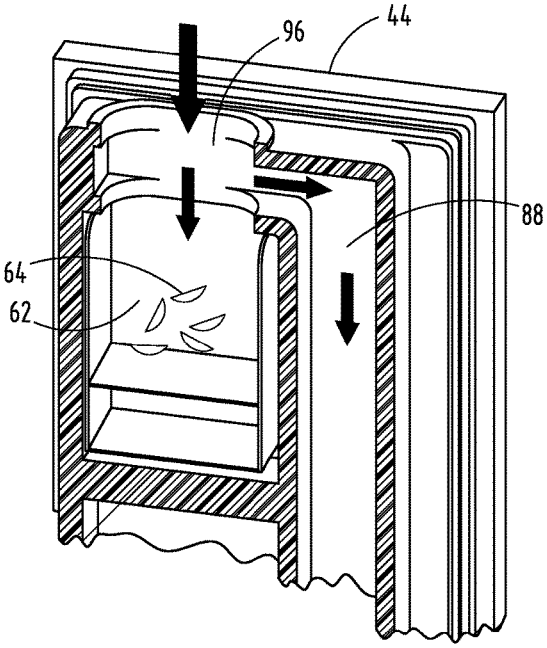
FIG. 16 is a perspective view of an embodiment of a refrigerator as shown in FIG. 15A, showing ducting for ice and air transfer.
Figure 15B:
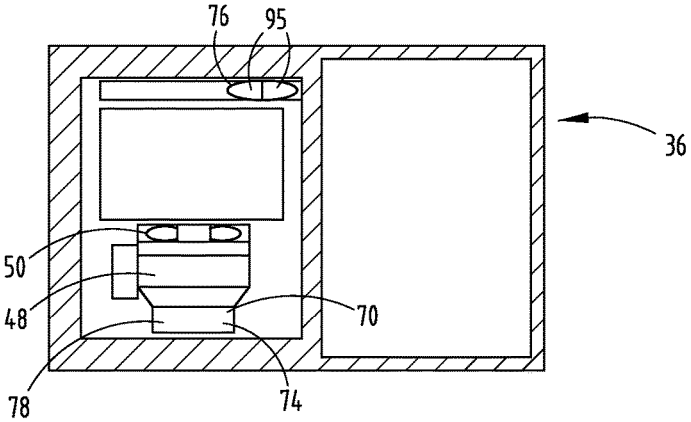
FIG. 15B is a cross sectional view of cooling module shown along the line XVB in FIG. 15A.

FIGS. 15A-16 illustrate an embodiment of a side-by-side refrigerator 30 with the removable cooling module 36 disposed thereon. The illustrated refrigerator 30 includes the combined duct 96, the cool air duct 88, and the return air duct 94. As shown in FIGS. 15A and 15B, the combined duct 96 includes a single delivery aperture or interface that expels ice 64 and cooled air from the cooling module 36. The interfaces 70, 74, 78 lead to the combined duct 96, which leads generally downwardly from the interfaces 70, 74, 78. The ice 64 is conveyed via gravity into the ice bin 62, and the cool air duct 88 then extends generally horizontally over the ice bin 64 and then downward into the refrigerating compartment 38 and the freezing compartment 40. The return air ducts 94 extend from the refrigerating compartment 38 and the freezing compartment 40, through communication with the return air interface 76, and back to the cooling module 36. Multiple return air ducts 94 can be used with one return air duct 94 extending from the refrigerating compartment 38 and one return air duct 94 extending from the freezing compartment 40. Alternatively, a single return air duct 94 can be used, which may be divided along its length into multiple passageways 95 (as illustrated in FIG. 15B).

As shown in FIG. 16, the combined duct 96 and the cool air duct 88 are provided in the freezing compartment door 44. Alternatively, the combined duct 96 and the cool air duct 88 can extend along a side or back of the refrigerating compartment 38 or the freezing compartment 40.

Figure 18:
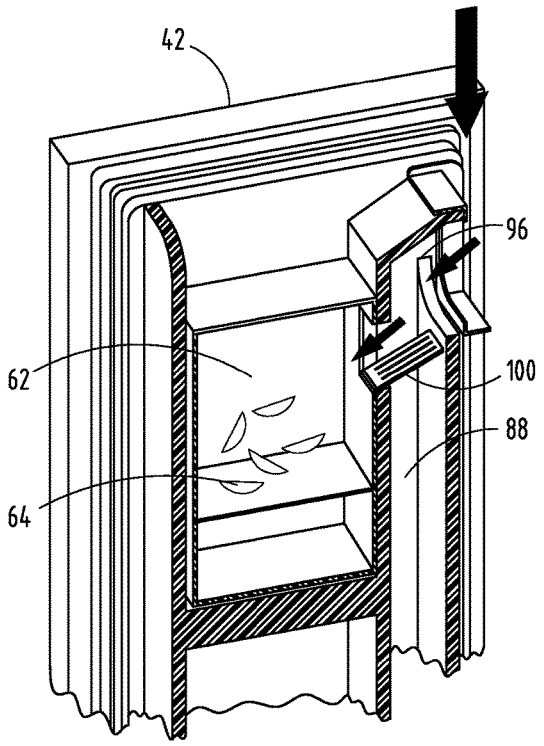
FIG. 18 is a perspective view of an embodiment of a refrigerator as shown in FIG. 17, showing ducting for ice and air transfer.

FIGS. 17 and 18 illustrate an embodiment of a freezer-on-bottom configuration of the refrigerator 30, with the removable cooling module 36 disposed thereon, including the combined duct 96, the cool air duct 88, and the return air duct 94. As shown in FIG. 17, a single aperture in the cooling module 36 performs the functions of the refrigerating compartment airflow interface, the freezing compartment air flow interface, and the ice dispensing interface. The aperture is in communication with the combined duct 96. The combined duct 96 includes the rotatable slotted deflector 100, which, when placed in a first position, blocks the ice 64 from traveling into the ice bin 62 and into the cool air duct 88. When the rotatable slotted deflector 100 is placed in a second position, as shown in FIG. 18, the ice 64 is deflected into the ice bin 62, and does not enter the cool air duct 88. As described with respect to FIGS. 15A-16, the return air ducts 94 extend from the refrigerating and freezing compartments 38, 40 up to the cooling module 36. As shown in FIG. 18, the ducts 88, 96 can also be provided in the refrigerating compartment door 42. In addition, the ducts 88, 96 can be provided along a side or back of the refrigerating compartment 38 or the freezing compartment 40, or along or within the wall separating the refrigerating and freezing compartments 38, 40 in a side-by-side configuration of the refrigerator 30. It is also contemplated that the ducts 88, 96 can be disposed in the insulation of the refrigerating and freezing compartments 38, 40, or fastened interior thereto.

Figure 19:
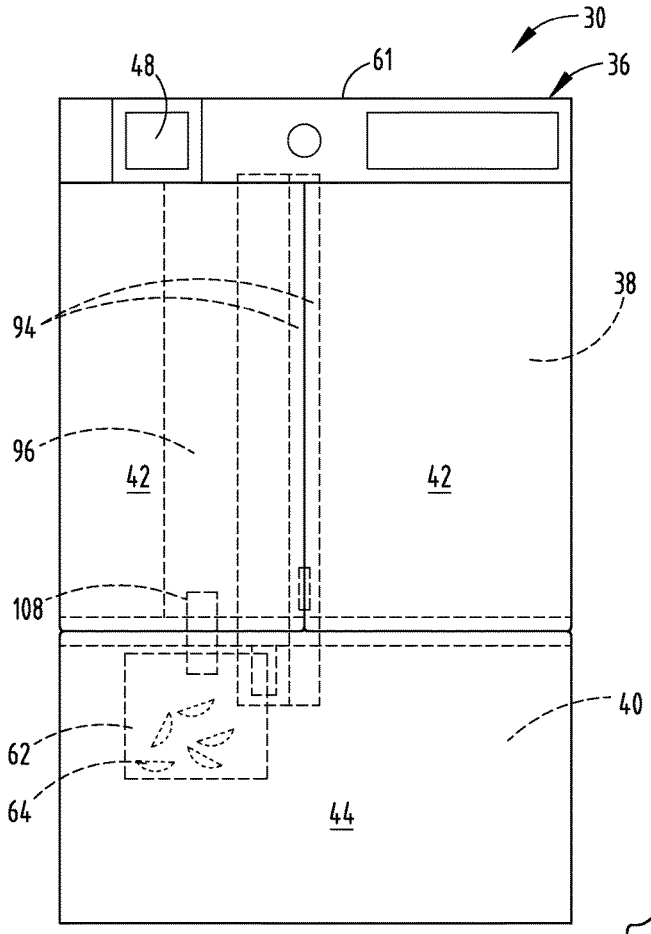
FIG. 19 is a front view of an embodiment of a freezer-on-bottom refrigerator.
Figure 20:
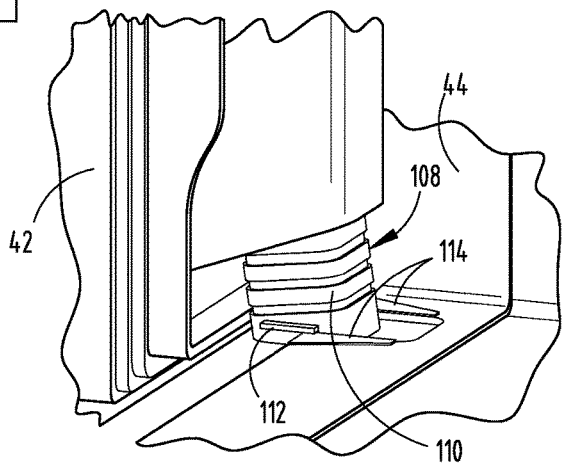
FIG. 20 is a perspective view of a gasket connecting a refrigerating compartment door duct to a freezing compartment door duct.

Referring now to the embodiment shown in FIG. 19, a freezer-on-bottom configuration of the refrigerator 30 includes the cooling module 36 disposed above the top wall 34 of the refrigerator 30, and includes the combined duct 96 to deliver the cooled air to the refrigerating compartment 38 and the freezing compartment 40. Ice 64 to the ice bin 62 is located in the freezing compartment 40. As shown in FIGS. 19 and 20, the combined duct 96 may traverse through the refrigerating compartment door 42 to the freezing compartment door 44.

In the embodiment shown in FIGS. 19 and 20, a flanged gasket 108 is used to provide an interface between the refrigerating compartment door 42 and the freezing compartment door 44. The flanged gasket 108 includes an expandable gasket 110 extending downwardly from the refrigerating compartment door 42, having flanges 112 extending laterally outwardly therefrom on each side. As shown in FIG. 20, a ramp 114 is provided to interface with each flange 112, having a raised portion at the front, so that when flanges 112 interact with the ramps 114, the expandable gasket 110 is held securely in place. When the door 42 is closed, and the flanges 112 are fully engaged with the ramps 114, the expandable gasket 110 expands, such that a tight connection is provided for the passage of the ice 64 and the cooled air from the refrigerating compartment door 42 to the freezing compartment door 44.

It will be understood by one having ordinary skill in the art that construction of the described invention and other components is not limited to any specific material. Other exemplary embodiments of the invention disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or moveable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the invention as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting. Further, one having ordinary skill in the art will understand and appreciate that features and components of some of the various embodiments disclosed herein are generally interchangeable and that the illustrated embodiments serve as exemplary configurations.

It is also to be understood that variations and modifications can be made on the aforementioned structures and methods without departing from the concepts of the present invention, and further it is to be understood that such concepts are intended to be covered by the following claims unless these claims by their language expressly state otherwise.

The above description is considered that of the illustrated embodiments only. Modifications of the invention will occur to those skilled in the art and to those who make or use the invention. Therefore, it is understood that the embodiments shown in the drawings and described above is merely for illustrative purposes and not intended to limit the scope of the invention, which is defined by the following claims as interpreted according to the principles of patent law, including the Doctrine of Equivalents.

The invention claimed is:

1. A removable cooling module for a refrigerator comprising:

a cooling unit positioned in a housing and removably coupled with a top wall of the refrigerator, the housing having a downwardly extending perimetrical alignment protrusion that is selectively inserted within a perimetrical channel integrally defined within the top wall of the refrigerator, the perimetrical channel being further defined within an interior portion of a top planar panel of the top wall;

an ice maker coupled to the cooling unit;

a module ice bin disposed in the housing and adapted to receive and store ice from the ice maker; and a duct in communication with the cooling unit and adapted to convey ice from the removable cooling module to an ice dispenser, wherein inserted engagement of the downwardly extending perimetrical alignment protrusion within the perimetrical channel aligns the duct to be in communication with the module ice bin, wherein the cooling unit is positioned entirely above the top wall of the refrigerator, and wherein the cooling unit and ice maker are disposed on top of a single platform of the housing.

2. The removable cooling module of claim 1, wherein a portion of the duct extends through a door of the refrigerator.

3. The removable cooling module of claim 2, wherein the refrigerator defines a cabinet, and wherein the ice is conveyed from the ice maker to the door, bypassing the cabinet, wherein the ice is conveyed from the ice maker to the door through a duct aperture defined within a top edge of the door, and wherein the duct engages the duct aperture outside of a boundary defined by the downwardly extending perimetrical alignment protrusion.

4. The removable cooling module of claim 1, wherein the duct conveys ice to an ice storage bin in the refrigerator and cool air to a refrigerating compartment and to a freezing compartment of the refrigerator.

5. The removable cooling module of claim 1, wherein the cooling unit includes the single platform defining an ice conveyance aperture that conveys ice to an interior of the refrigerator.

6. The removable cooling module of claim 1, wherein the single platform defines an ice and airflow interface that conveys cool air from the cooling unit to an interior of the refrigerator, the ice and airflow interface including a gasket assembly positioned between the removable cooling module and the refrigerator, wherein the perimetrical channel is defined within the gasket assembly and the perimetrical channel includes a "U" shaped cross section that extends at least partially into the top wall, and wherein engagement of the housing with the refrigerator defines a gravity connection that is free of fasteners.

7. The removable cooling module of claim 6, wherein the gasket assembly includes a flexible gasket disposed on one of the removable cooling module and the refrigerator, wherein the flexible gasket and the downwardly extending perimetrical alignment protrusion include complementary configurations that maintain a substantially airtight seal between the removable cooling module and the refrigerator.

8. A removable cooling module for a refrigerator comprising:

a platform and a housing coupled to the platform, the platform and housing generally defining a cavity and a downwardly extending peripheral alignment protrusion extending around a perimeter of at least one of the platform and the housing;

a cooling unit and an ice maker disposed in the cavity, wherein the cooling unit and the ice maker are disposed on an upper surface of the platform;

an ice conveyance aperture extending through the platform of the removable cooling module and which conveys ice formed by the ice maker inside the cavity to a position outside the cavity; and an airflow interface that conveys cool air from inside the removable cooling module to an interior portion of the refrigerator, wherein the airflow interface is positioned within a boundary defined by the downwardly extending peripheral alignment protrusion, wherein one of the housing and the platform is coupled with a top wall of the refrigerator, the top wall of the refrigerator defining an integral perimetrical channel that selectively receives the downwardly extending peripheral alignment protrusion, the integral perimetrical channel being distal from an outer edge of the top wall of the refrigerator.

9. The removable cooling module of claim 8, wherein the airflow interface includes a first cool air aperture and a second cool air aperture.

10. The removable cooling module of claim 9, wherein the first cool air aperture relays cool air to a freezing compartment and the second cool air aperture relays cool air to a refrigerating compartment.

11. The removable cooling module of claim 8, wherein the refrigerator comprises a refrigerating compartment and a freezing compartment, and wherein a duct is in communication with the airflow interface and relays cool air from the cooling unit to the refrigerating compartment and the freezing compartment.

12. The removable cooling module of claim 8, wherein ice is directed from the removable cooling module to an ice storage bin in one of a freezing compartment and a refrigerating compartment.

13. The removable cooling module of claim 8, wherein ice from the ice maker is conveyed to an ice dispenser disposed in a door of the refrigerator, and wherein the ice conveyance aperture is positioned at least partially outside of a boundary defined by the peripheral alignment protrusion.

14. The removable cooling module of claim 8, wherein the refrigerator includes a door with an ice dispenser, and wherein the ice conveyance aperture is in communication with the door such that ice can be directed from the ice conveyance aperture through the door to the ice dispenser.

15. The removable cooling module of claim 8, wherein the refrigerator includes a door with a cool air duct that conveys air from the airflow interface to the interior portion of the refrigerator.

16. A removable cooling module for a refrigerator comprising:

a platform directly and removably coupled with a top wall of the refrigerator, the platform defining an airflow interface and an ice conveyance aperture, wherein the platform includes a downwardly extending alignment protrusion that engages a channel integrally defined in an interior portion of the top wall of the refrigerator, the channel having a "U" shaped cross section;

a cooling unit positioned on the platform, the cooling unit in communication with a first cool air aperture that conveys cool air to a freezing compartment of the refrigerator and a separate second cool air aperture that conveys cool air to a refrigerating compartment, wherein the cooling unit is positioned above the top wall of the refrigerator and in direct engagement with the platform, and wherein the first and second cool air apertures are defined in the top wall; and an ice maker positioned directly on the platform, the ice maker in communication with the ice conveyance aperture, such that ice from the ice maker is conveyed to an interior of the refrigerator, wherein ice from the ice maker is conveyed to the refrigerator at least through a duct aperture defined within a top edge of a door of the refrigerator, wherein the ice conveyance aperture is positioned outside of a boundary defined by the channel integrally defined within the top wall of the refrigerator.

17. The removable cooling module of claim 16, wherein ice is directed from the removable cooling module to an ice storage bin in one of the freezing compartment and the refrigerating compartment.

18. The removable cooling module of claim 16, wherein ice from the ice maker is conveyed to an ice dispenser disposed in a door of the refrigerator.

19. The removable cooling module of claim 16, wherein the cooling unit includes a low-profile linear compressor.

* * * * *